US009502846B1

(12) United States Patent
Peng

(10) Patent No.: US 9,502,846 B1
(45) Date of Patent: Nov. 22, 2016

(54) PLUG-IN TYPE POWER ADAPTER

(71) Applicant: Rich Brand Industries Limited, Dongguan, Guangdong Province (CN)

(72) Inventor: Te-Shui Peng, Taoyuan (TW)

(73) Assignee: Rich Brand Industries Limited, Dongguan (CN)

( * ) Notice: Subject to any disclaimer, the term of this patent is extended or adjusted under 35 U.S.C. 154(b) by 0 days.

(21) Appl. No.: 14/849,640

(22) Filed: Sep. 10, 2015

(51) Int. Cl.
*H01R 25/00* (2006.01)
*H01R 31/06* (2006.01)

(52) U.S. Cl.
CPC ..... *H01R 31/06* (2013.01)

(58) Field of Classification Search
CPC ..... H01R 31/06; H01R 13/625; H01R 33/94
USPC ..... 439/641
See application file for complete search history.

(56) References Cited

U.S. PATENT DOCUMENTS 3,349,310 A * 10/1967 Ladoniczki ..... H02H 11/002 307/127
3,705,842 A * 12/1972 Barbato ..... C25B 15/00 204/219
7,745,982 B2 * 6/2010 Rosenmuller ..... H01J 5/54 313/25
8,201,985 B2 * 6/2012 Cao ..... F21V 3/02 362/649
2007/0077820 A1 * 4/2007 Stull ..... H01R 13/625 439/620.04
2011/0021081 A1 * 1/2011 Lin ..... H01R 33/94 439/641
2011/0162627 A1 * 7/2011 Hung ..... F02P 3/0407 123/647

* cited by examiner

*Primary Examiner* — Jean F Duverne

(74) *Attorney, Agent, or Firm* — Alan D. Kamrath; Kamrath IP Lawfirm, P.A.

(57) ABSTRACT

Disclosed is a plug-in power adapter connectable into a screwing portion of a conventional lamp holder by a screwing connection, and power is supplied to the power adapter, and the power adapter is provided for connecting a power cable of an electric appliance to supply power to the electric appliance. When two bare ends of the power cable are connected to the power adapter and clamped by two wire clipping ends respectively to prevent the power cable from falling out easily, so as to achieve the effects of connecting the power cable securely and preventing the cable from being loosened or separated by external forces.

2 Claims, 7 Drawing Sheets

PLUG-IN TYPE POWER ADAPTER

BACKGROUND

Technical Field

The technical field relates to a plug-in power adapter, and more particularly to a power adapter capable of screwing and connecting a conventional lamp holder to electrically conduct a power supply. During use, the plug-in power adapter is electrically connected to a power cable of an electric appliance to supply electric power to other electric appliances. In the meantime, the power cable connected to the power adapter is clamped securely to prevent the power cable from being separated from the power adapter.

Description of the Related Art

With reference to FIG. 1 for a conventional lamp holder 10, the lamp holder 10 is installed at the middle of the inner top of a lampshade 11 and electrically connected to an external power supply (such as the mains power) by an upwardly extended power cable 12, and the lampshade 11 is generally embedded into a board 13 disposed at a high position. During use, the lamp holder 10 is provided for screwing a head portion of a bulb 14 therein. When the power supply is turned on, the bulb 14 will emit light in a direction from top to bottom. Since the lamp is installed at a high position, such lamp is called a "down light".

The lamp holder 10 is a common conventional electric component comprising a screwing portion for receiving and connecting the head portion of the bulb 14, so that the screwing portion of the lamp holder 10 is electrically connected to the power cable 12 for supplying electric power to the bulb 14 at appropriate time. The lamp holder 10 has two main functions including the functions of connecting the bulb 14 and supplying power to the bulb 14. The lamp holder 10 may be installed at a high position to provide a "down light" mode or used in other modes as a ceiling lamp, a table lamp, a desk lamp or a floor lamp.

The bulb 14 may be a light emitting element. The bulb 14 at an early stage adopts tungsten to emit light (or uses tungsten as the light emitting element), and the bulb 14 is generally in a spherical shape and has a screw head formed at a connecting position and screwed into a screwing portion of the lamp holder 1, so that the spherical portion is suspended outside the lamp holder 10 as shown in FIG. 1. As technology advances, various different types of light emitting elements are developed, and they are not limited to tungsten for emitting light. In recent years, LED is developed to produce various different types of light emitting elements and their appearance is no longer limited to the spherical shape. For example, a flat LED light emitting element is often applied for projecting light from a high position.

1. With reference to FIG. 1 for a down light, the down light is extensively used as a lamp in many families. To save power, the flat LED light emitting element is used, and the most convenient arrangement resides on that users need not to remove the lampshade 11 to access the same area of an opening surface of the lampshade 11 in order to install the flat LED light emitting element, so that the flat LED light emitting element can be installed in the opening surface of the lampshade 11 securely to replace the aforementioned down light at the same position and achieve the same effect of projecting light downward. Such modification saves lots of labor and cost. However, the way of electrically conduct the LED light emitting element installed in the opening surface to a power supply is a skill of the modification. In general, a connecting wire of the LED light emitting element is connected directly to the power cable 12, but such connection may have the drawbacks of electric shocks and unintentional disconnection or detachment at the wire connecting position after a long time of use. Obviously, the prior art requires improvements.

SUMMARY

In view of the foregoing drawbacks of the prior art, the inventor of this disclosure designed and developed a plug-in power adapter to overcome the drawbacks of the prior art.

Therefore, it is a primary objective of this disclosure to provide a power adapter capable of screwing and connecting a conventional lamp holder, electrically conducting a power supply, and connecting and conducting a power cable of an electric appliance to supply electric power to other electric appliances.

Another objective of this disclosure is to provide a plug-in power adapter capable of connecting a power cable securely and preventing the power adapter from being loosened or separated by external forces.

To achieve the aforementioned object, this disclosure provides a plug-in power adapter comprising a main body, a bottom cover, an adapting cylinder, an anode clip, a cathode clip, a gasket, an anode connecting member and a cathode connecting member.

The main body is formed by integrating a cylindrical portion and a disc-shaped portion, and a bump is protruded from the top side of the cylindrical portion, and an anode connecting slot is formed at the middle of the cylindrical portion and penetrated therein, and a cathode connecting slot is formed separately on both sides of the cylindrical portion and penetrated therein, and the bottom of the cylindrical portion is in an inwardly hollow shape and having a plurality of pillars configured to be corresponsive to the anode connecting slot and the cathode connecting slot and comprising an anode clip slot and a cathode clip slot, and the anode clip slot is communicated with the anode connecting slot, and the cathode clip slot is communicated with one of the cathode connecting slots, and the disc-shaped portion is expanded outward and disposed at the bottom of the cylindrical portion, and the inner edge of the bottom of the cylindrical portion has a plurality of latching slots.

The bottom cover comprises an anode clip slot and a cathode clip slot formed at the top of the bottom cover, a plurality of latching hooks formed at an outer periphery of the bottom cover, an anode plug-in hole and a cathode plug-in hole formed at the bottom of the bottom cover, and the anode plug-in hole and the anode clip slot are communicated with each other, and the cathode plug-in hole is communicated with the cathode clip slot.

The adapting cylinder in a cylindrical shape is made of an electrically conductive material and has a spiral screw thread formed on a wall of the adapter cylinder, a large hollow formed at the middle of the top of the adapter cylinder, and a through hole formed separately on both lateral sides of the adapter cylinder, and the large hollow is corresponsive to the bump protruded from the top of the cylindrical portion of the main body.

The anode clip has a connecting hole formed on a horizontal plate at the top of the anode clip and extended downward to finally form a wire clipping end, and the cathode clip has a connecting hole formed on a horizontal plate of the cathode clip and extended downward to finally form a wire clipping end.

The gasket is in the shape of a circular disc, and has a large hollow formed at the middle of the gasket and a through hole formed separately on both lateral side of the gasket, and the large hollow is corresponsive to the large hollow of the adapting cylinder and the bump of the main body, and the anode connecting member is a pivot, and the cathode connecting member is also a pivot During assembling, an end of the anode clip having the connecting hole is installed into the anode clip slot of the main body, and the anode connecting member is passed from the main body and installed into the anode connecting slot and fixed after passing through the connecting hole, and an end of the cathode clip having the connecting hole is installed and passed into the cathode clip slot of the main body, such that the connecting hole is aligned precisely with one of the cathode connecting slots, and the adapting cylinder is covered onto the exterior of the main body, such that the large hollow of the adapting cylinder is sheathed on the bump of the main body, and the two through holes are aligned precisely and respectively with the two cathode connecting slots, and the gasket is attached onto the top of the adapting cylinder, so that the large hollow of the gasket is sheathed on the bump of the main body, and the two through holes of the gasket are aligned precisely and respectively with the two through holes and the two cathode connecting slots of the adapting cylinder, and the two cathode connecting members are passed through the two through holes of the gasket and the two through holes of the adapting cylinder respectively and then installed into the two cathode connecting slots of the main body respectively, and one of the cathode connecting members is fixed after passing through the connecting hole of the cathode clip, and the other cathode connecting member is fixed after passing out from a cathode connecting slot, and the bottom cover is covered onto the bottom of the disc-shaped portion of the main body from bottom to top, so that the latching hook and the latching slot are latched correspondingly, and the wire clipping end of the anode clip is accommodated in the anode clip slot of the bottom cover, and the wire clipping end of the cathode clip is accommodated in the cathode clip slot of the bottom cover.

In the aforementioned plug-in power adapter, a positioning groove is formed at an outer periphery of the bottom of the disc-shaped portion of the main body the main body, and a positioning bump formed at an outer periphery of the top of the bottom cover, such that the positioning bump of the bottom cover may be installed and positioned into the positioning groove of the main body for assembling.

DETAILED DESCRIPTION OF THE PREFERRED EMBODIMENTS

The technical characteristics, contents, advantages and effects of this disclosure will be apparent with the detailed description of a preferred embodiment accompanied with related drawings as follows.

Figure 1:
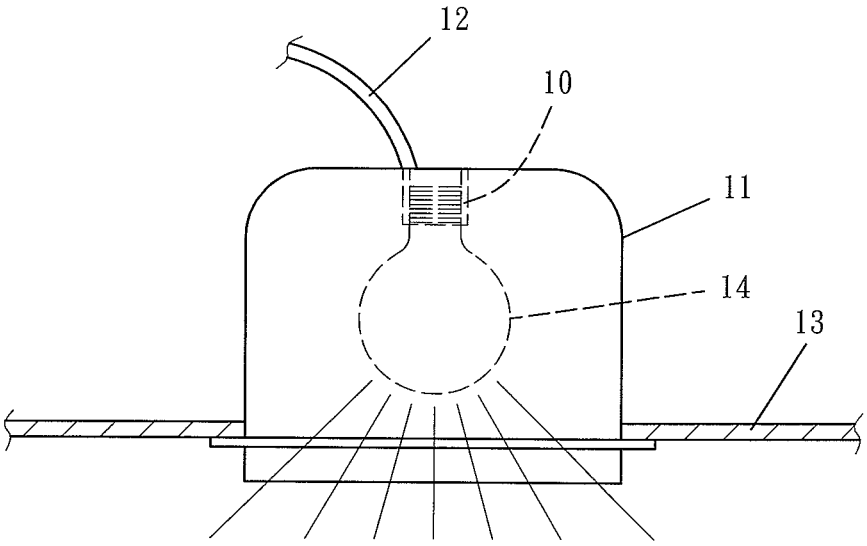
FIG. 1 (PRIOR ART)
FIG. 1 is a perspective view of a conventional lamp holder in a down light mode.
Figure 2:
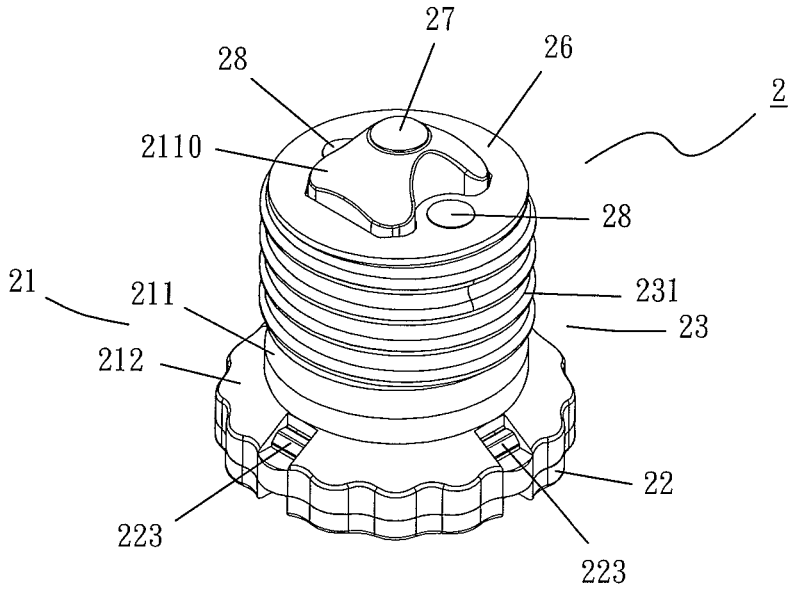
FIG. 2 is a perspective view of a preferred embodiment of this disclosure viewing at an angle of depression.
Figure 3:
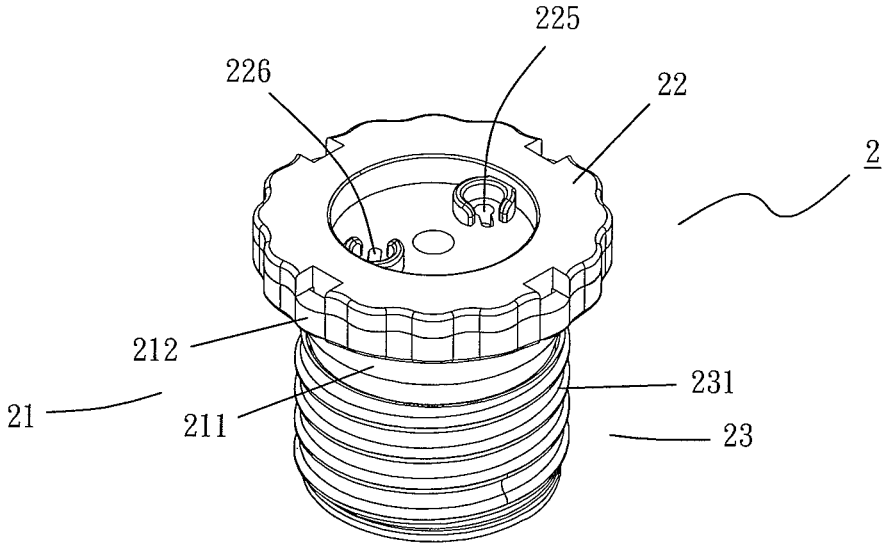
FIG. 3 is a perspective view of a preferred embodiment of this disclosure viewing at an angle of elevation.
Figure 4:
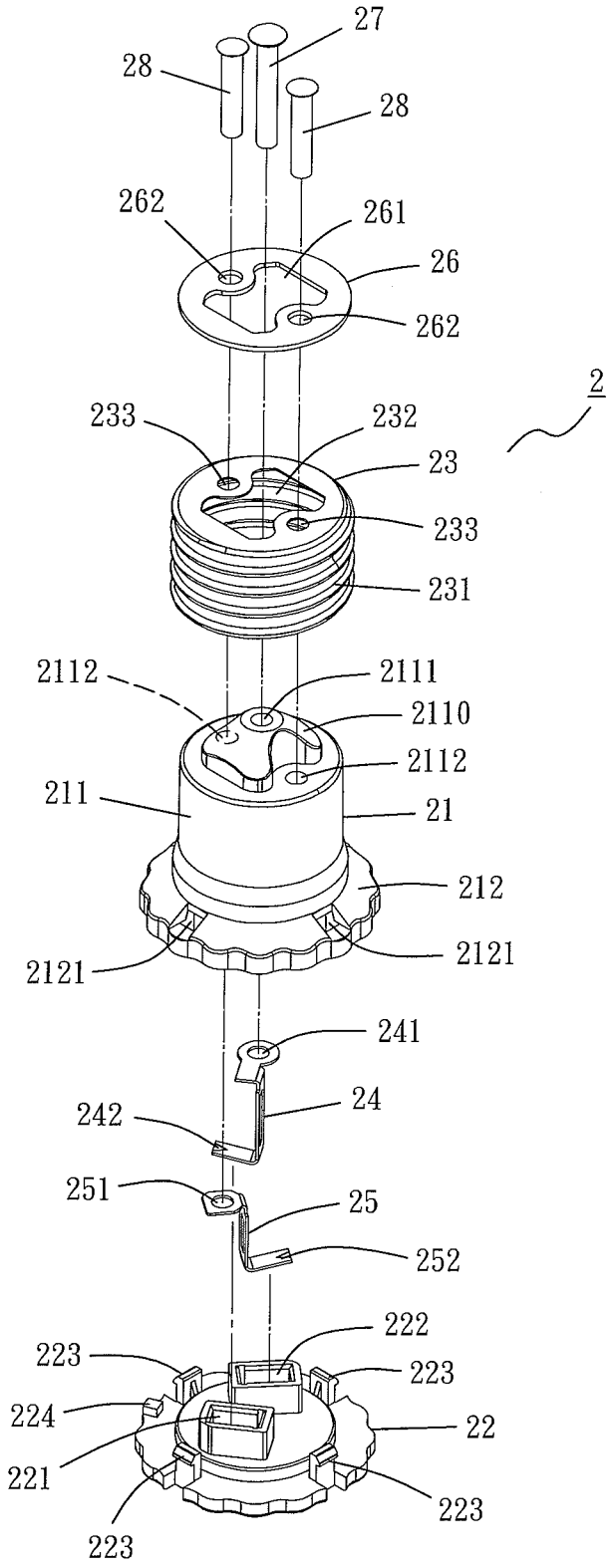
FIG. 4 is an exploded view of a preferred embodiment of this disclosure viewing at an angle of depression.
Figure 5:
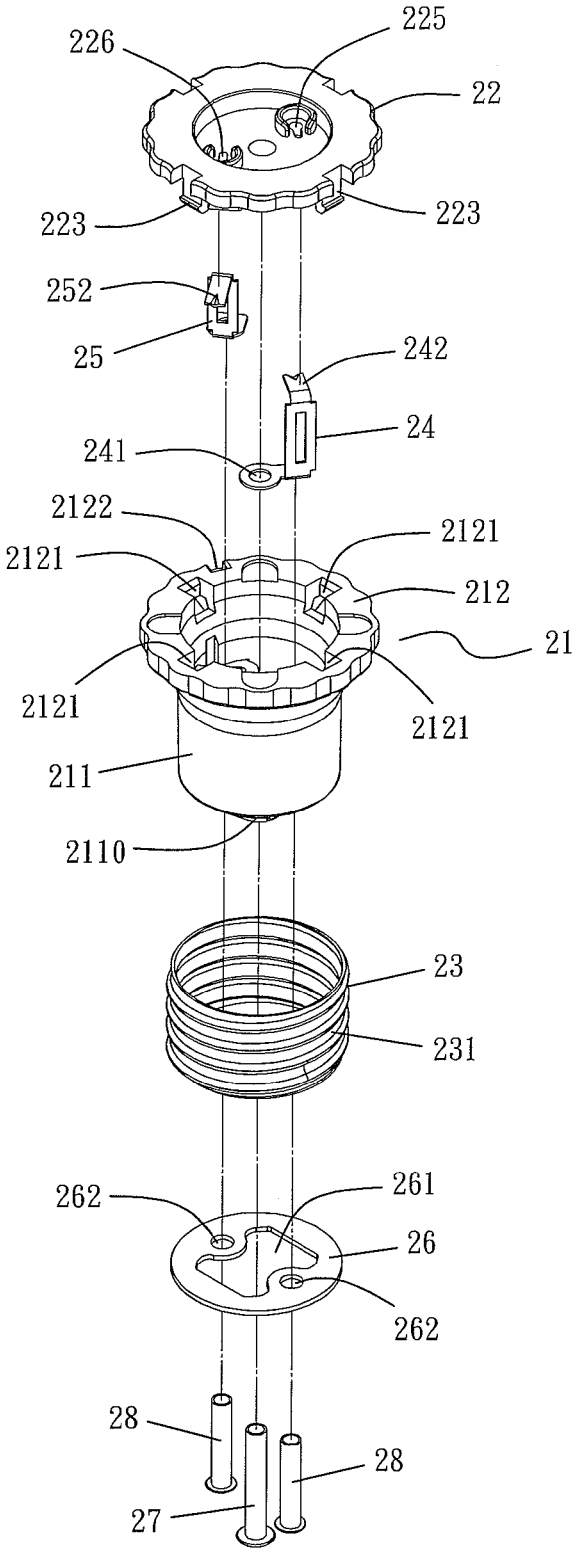
FIG. 5 is an exploded view of a preferred embodiment of this disclosure viewing at an angle of elevation.

With reference to FIGS. 2 and 3 for the perspective views of a power adapter 2 and FIGS. 4 and 5 for the exploded views of the power adapter 2 in accordance with a preferred embodiment of this disclosure respectively, the power adapter 2 comprises a main body 21, a bottom cover 22, an adapting cylinder 23, an anode clip 24, a cathode clip 25, a gasket 26, an anode connecting member 27 and a cathode connecting member 28.

Figure 6:
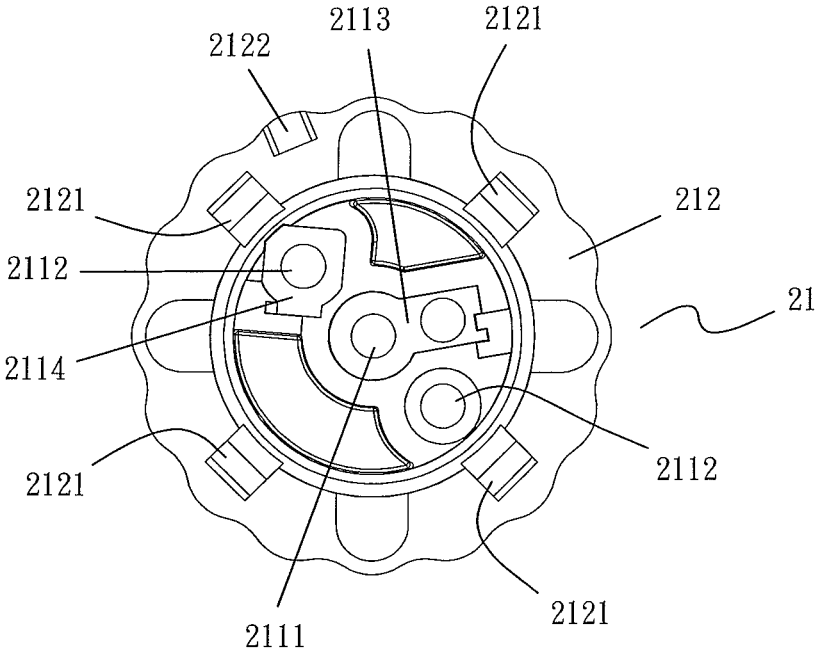
FIG. 6 is a bottom view of a main body of a preferred embodiment of this disclosure.
Figure 7:
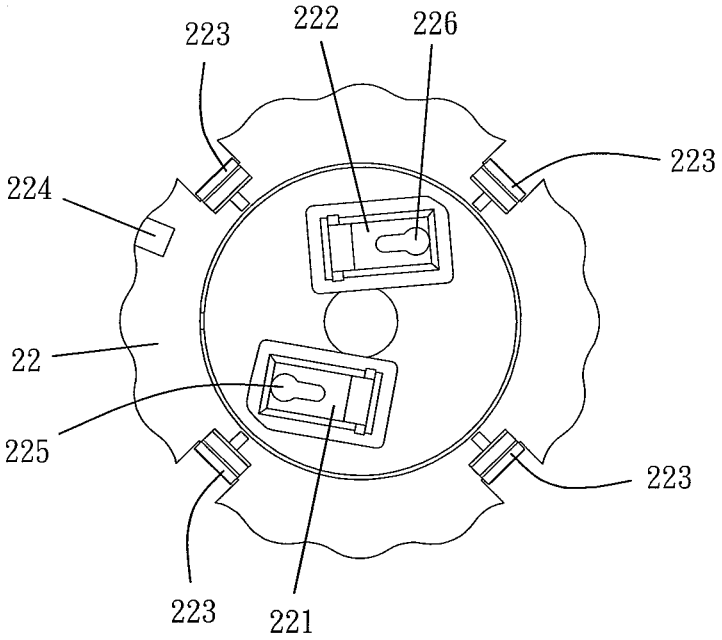
FIG. 7 is a top view of a cover of a preferred embodiment of this disclosure.
Figure 8:
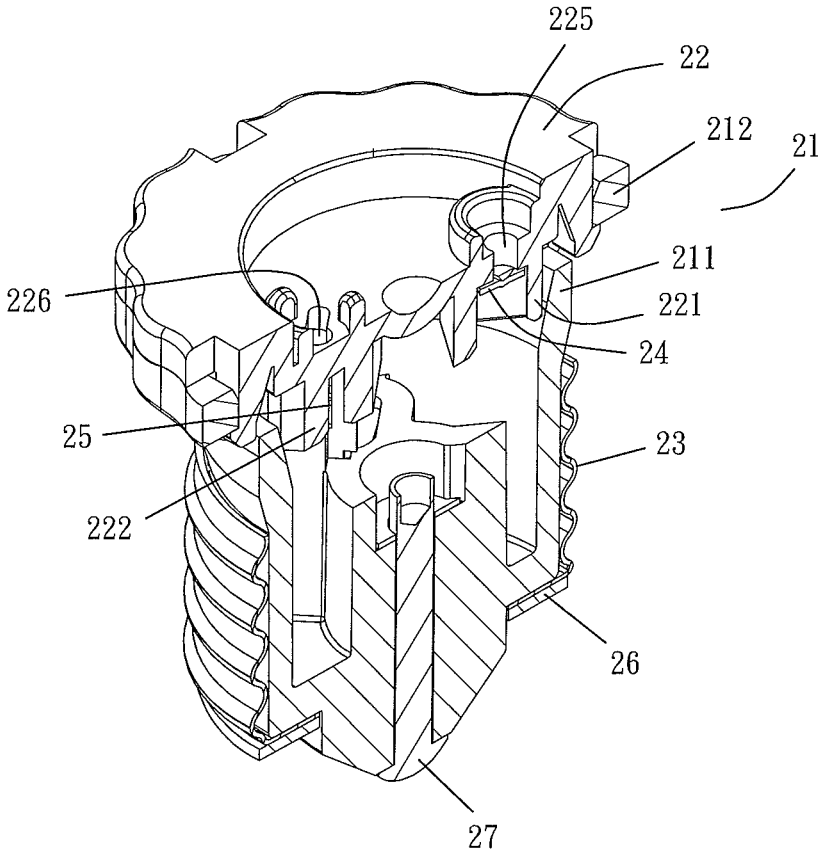
FIG. 8 is a cross-sectional perspective view of a preferred embodiment of this disclosure.

In FIGS. 4, 5, 6, and 8, the main body 21 is formed by integrating a cylindrical portion 211 and a disc-shaped portion 212, and a bump 2110 is protruded from the top of the cylindrical portion 211, and an anode connecting slot 2111 is formed at the middle of the cylindrical portion 211 and penetrated into the cylindrical portion 211, and a cathode connecting slot 2112 is formed separately on both sides of the cylindrical portion 211 and penetrated into the cylindrical portion 211, and the bottom of the cylindrical portion 211 has an inwardly concave hollow (as shown in FIG. 5), and the interior of the cylindrical portion 211 has the anode connecting slot 2111 and the cathode connecting slot 2112 to form a plurality of pillars and further includes an anode clip slot 2113 and a cathode clip slot 2114 (as shown in FIG. 6), and the anode clip slot 2113 is communicated with the anode connecting slot 2111, and the cathode clip slot 2114 is communicated with one of the cathode connecting slots 2112, and the disc-shaped portion 212 is expanded outward and disposed at the bottom of the cylindrical portion 211, and the inner edge of the bottom of the cylindrical portion 211 has a plurality of latching slots 2121 and the outer periphery of the cylindrical portion 211 has a positioning groove 2122 (as shown in FIG. 5).

In FIGS. 4, 5, 7, and 8, the bottom cover 22 has an anode clip slot 221 and a cathode clip slot 222 formed at the top of the bottom cover 22, a plurality of latching hooks 223 and a positioning bump 224 formed at an outer periphery of the bottom cover 22, and an anode plug-in hole 225 and a cathode plug-in hole 226 formed at the bottom of the bottom cover 22, wherein the anode plug-in hole 225 is communicated with the anode clip slot 221, and the cathode plug-in hole 226 is communicated with the cathode clip slot 222.

In FIGS. 4 and 5, the adapting cylinder 23 in a cylindrical shape is made of an electrically conductive material and has a spiral screw thread 231 formed on a wall of the adapting cylinder 23, a large hollow 232 formed at the middle of the top of the adapting cylinder 23, and a through hole 233 formed separately on both lateral side of the adapting cylinder 23, and the large hollow 232 is configured to be corresponsive to the bump 2110.

The anode clip 24 has a connecting hole 241 formed on a horizontal plate of the top of the anode clip 24 and extended downward to finally form a wire clipping end 242, and the cathode clip 25 has a connecting hole 251 formed on a horizontal plate of the top of the cathode clip 25 and extended downward to finally form a wire clipping end 252.

The gasket 26 in a circular shape is made of a material with an appropriate hardness and has a large hollow 261 formed at the middle of the gasket 26 and a through hole 262 formed separately on both lateral side of the gasket 26, and the large hollow 261 is configured to be corresponsive to the large hollow 232 of the adapting cylinder 23 and the bump 2110 of the main body 21, and both of the anode connecting member 27 and the cathode connecting member 28 are pivots, and preferably rivets.

During assembling, an end of the anode clip 24 having the connecting hole 241 is installed into the anode clip slot 2113 of main body 21, and the connecting hole 241 is aligned precisely with the anode connecting slot 2111, and then the anode connecting member 27 is passed from the main body 21 into the anode connecting slot 2111 and fixed after passing through the connecting hole 241, and an end of the cathode clip 25 having the connecting hole 251 is installed into the cathode clip slot 2114 of the main body 21, and the connecting hole 251 is aligned precisely with one of the cathode connecting slots 2112, while the adapting cylinder 23 is covered onto the exterior of the main body 21, and the large hollow 232 of the adapting cylinder 23 is sheathed on the of bump 2110, the main body 21, and the two through holes 233 are aligned precisely and respectively with the cathode connecting slots 2112 on both sides of the bump 2110, and then the gasket 26 is attached onto the top of the adapting cylinder 23, and the large hollow 261 of the gasket 26 is also sheathed on the bump 2110 of the main body 21, and the two through holes 262 are aligned precisely and respectively with the two through holes 233 and the two cathode connecting slots 2112.

After passing through the two through holes 262 and the two through holes 233 respectively, the two cathode connecting members 28 also pass into the two cathode connecting slots 2112 of the main body 21, and one of the cathode connecting members 28 is fixed after passing through the connecting hole 251 of the cathode clip 25, and the other cathode connecting member 28 is fixed after passing out of the cathode connecting slot 2112. Now, the anode clip 24 and the cathode connecting member 28 are fixed into the anode connecting slot 2111 and the cathode connecting slot 2112 of the main body 21 through the connection of the anode connecting member 27 and the cathode connecting member 28, and the main body 21, the adapting cylinder 23 and the gasket 26 are fixed with one another.

Finally, the positioning bump 224 of the bottom cover 22 is aligned precisely with the positioning groove 2122 of the main body 21, so that the bottom cover 22 is covered onto the bottom of the disc-shaped portion 212 of the main body 21 from bottom to top, and the plurality of latching hooks 223 at the top of the bottom cover 22 and the plurality of latching slots 2121 at the bottom of the disc-shaped portion 212 are latched with each other respectively, so that the bottom cover 22 and the disc-shaped portion 212 are combined securely. During this process, the wire clipping end 242 of the anode clip 24 is accommodated and remained in the anode clip slot 221 of the bottom cover 22, and the wire clipping end 252 of the cathode clip 25 is accommodated and remained in the cathode clip slot 222 of the bottom cover 22, so as to assembly the power adapter 2.

Figure 9:
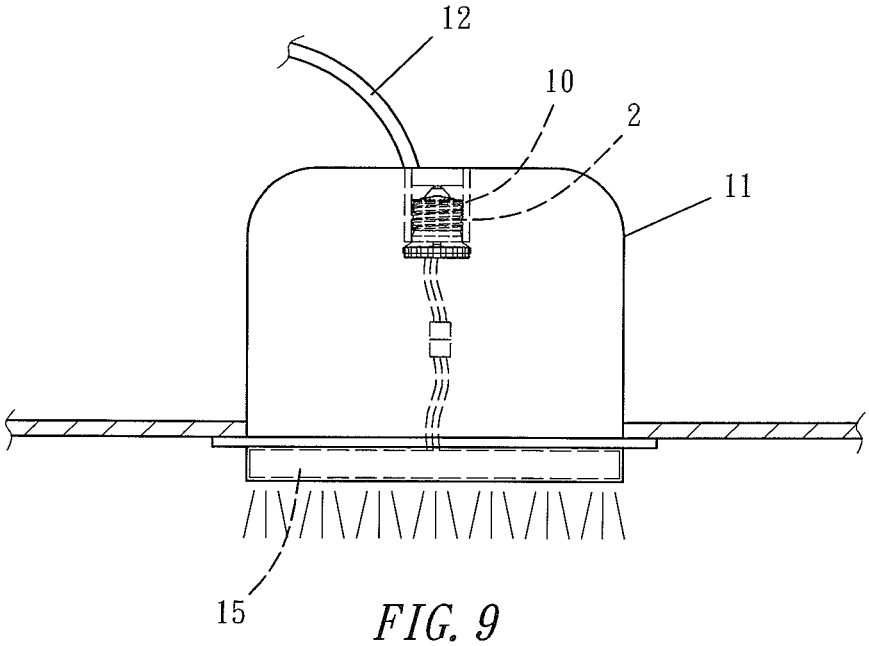
FIG. 9 is a schematic view of a power adapter combined with a lamp holder in accordance with this disclosure.

With reference to FIG. 9 for the use of the power adapter 2, the power adapter 2 is screwed into the screwing portion of a conventional lamp holder 10 by the screw thread 231 formed on a wall of the adapting cylinder 23, so that the whole power adapter 2 is combined with the conventional lamp holder 10, and an outer end of the anode connecting member 27 of the power adapter 2 is electrically conducted with the anode in the conventional lamp holder 10. Since the adapting cylinder 23 is in contact with the screwing portion of the conventional lamp holder 10, the cathode of the conventional lamp holder 10 is electrically conducted. Therefore, power is passed through the anode and cathode connecting members 27, 28 and transmitted to the anode and cathode clips 24, 25 through the anode and cathode of the power supply respectively.

When two bare ends of the power cable of the flat LED light emitting element 15 installed in an opening surface of the conventional lampshade 11 are inserted from the anode plug-in hole 225 and the cathode plug-in hole 226 of the power adapter 2 respectively, the two bare ends will be in contact with the wire clipping end 242 of the anode clip 24 and the wire clipping end 252 of the cathode clip 25 respectively, and then when a force is applied to push the two bare ends, the two bare ends will push and press the corresponding wire clipping ends 242, 252 to bend inward, so as to allow the two bare ends to enter and remain in the anode clip slot 221 and the cathode clip slot 222 through the wire clipping ends 242, 252. When the force is released, the two bare ends are clamped by the inner walls of the anode clip slot 221 and the cathode clip slot 222 due to the resilience of the material of two wire clipping ends 242, 252 and no longer fall out easily, and the anode and cathode of the power supply is electrically conducted to the LED light emitting element 15 to supply power to the LED light emitting element 15 to emit light.

This disclosure discloses a power adapter 2 that is screwed and connected into a screwing portion of a conventional lamp holder 10, so that the power adapter 2 can be connected to the conventional lamp holder 10, and the power of the conventional lamp holder 10 is transmitted to the power adapter 2, and the power adapter 2 is provided for plugging and electrically conducting a power cable of an electric appliance to supply power to the electric appliance. When the two bare ends of the power cable are plugged to the power adapter 2, the two bare ends are clamped by the two wire clipping ends, so that the power cable will not fall out easily, so as to achieve the expected effects of connecting the power cable securely and preventing the power cable from being loosened or separated by external forces.

In summation of the description above, this disclosure complies with the patent application requirements, and thus is duly filed for patent application. While the disclosure has been described by means of specific embodiments, numerous modifications and variations could be made thereto by those skilled in the art without departing from the scope and spirit of the disclosure set forth in the claims.

What is claimed is:

1. A plug-in power adapter, comprising a main body, a bottom cover, an adapting cylinder, an anode clip, a cathode clip, a gasket, an anode connecting member and a cathode connecting member, characterized in that the main body is formed by integrating a cylindrical portion and a disc-shaped portion, and a bump is protruded from the top of the cylindrical portion, and an anode connecting slot is formed at the middle of the cylindrical portion and penetrated into the cylindrical portion, and the bottom of the cylindrical portion is inwardly concave, and the interior of the cylindrical portion has the anode connecting slot and the cathode connecting slot to form a plurality of columns and further includes an anode clip slot and a cathode clip slot which are communicated with one another, and the cathode clip slot is communicated with one of the cathode connecting slots, and the disc-shaped portion is expanded outward and disposed at the bottom of the cylindrical portion, and the inner edge of the bottom of the cylindrical portion has a plurality of latching slots;

the bottom cover comprises an anode clip slot and a cathode clip slot formed at the top of the bottom cover, a plurality of latching hooks formed at an outer periphery of the bottom cover, an anode plug-in hole and a cathode plug-in hole formed at the bottom of the bottom cover, and the anode plug-in hole and the anode clip slot are communicated with each other, and the cathode plug-in hole is communicated with the cathode clip slot;

the adapting cylinder in a cylindrical shape is made of an electrically conductive material and has a spiral screw thread formed on a wall of the adapter cylinder, a large hollow formed at the middle of the top of the adapter cylinder, and a through hole formed separately on both lateral sides of the adapter cylinder, and the large hollow is corresponsive to the bump protruded from the top of the cylindrical portion of the main body;

the anode clip has a connecting hole formed on a horizontal plate at the top of the anode clip and extended downward to finally form a wire clipping end, and the cathode clip has a connecting hole formed on a horizontal plate of the cathode clip and extended downward to finally form a wire clipping end;

the gasket is in the shape of a circular disc, and has a large hollow formed at the middle of the gasket and a through hole formed separately on both lateral side of the gasket, and the large hollow is corresponsive to the large hollow of the adapting cylinder and the bump of the main body, and the anode connecting member is a pivot, and the cathode connecting member is also a pivot;

during assembling, an end of the anode clip having the connecting hole is installed into the anode clip slot of the main body, and the anode connecting member is passed from the main body and installed into the anode connecting slot and fixed after passing through the connecting hole, and an end of the cathode clip having the connecting hole is installed and passed into the cathode clip slot of the main body, such that the connecting hole is aligned precisely with one of the cathode connecting slots, and the adapting cylinder is covered onto the exterior of the main body, such that the large hollow of the adapting cylinder is sheathed on the bump of the main body, and the two through holes are aligned precisely and respectively with the two cathode connecting slots, and the gasket is attached onto the top of the adapting cylinder, so that the large hollow of the gasket is sheathed on the bump of the main body, and the two through holes of the gasket are aligned precisely and respectively with the two through holes and the two cathode connecting slots of the adapting cylinder, and the two cathode connecting members are passed through the two through holes of the gasket and the two through holes of the adapting cylinder respectively and then installed into the two cathode connecting slots of the main body respectively, and one of the cathode connecting members is fixed after passing through the connecting hole of the cathode clip, and the other cathode connecting member is fixed after passing out from a cathode connecting slot, and the bottom cover is covered onto the bottom of the disc-shaped portion of the main body from bottom to top, so that the latching hook and the latching slot are latched correspondingly, and the wire clipping end of the anode clip is accommodated in the anode clip slot of the bottom cover, and the wire clipping end of the cathode clip is accommodated in the cathode clip slot of the bottom cover.

2. The plug-in power adapter according to claim 1, further comprising a positioning groove formed at an outer periphery of the bottom of the disc-shaped portion of the main body, a positioning bump formed at an outer periphery of the top of the bottom cover, such that the positioning bump of the bottom cover may be installed and positioned into the positioning groove of the main body for assembling.

* * * * *